US012352017B2

(12) United States Patent
Takayama et al.

(10) Patent No.: US 12,352,017 B2
(45) Date of Patent: Jul. 8, 2025

(54) SYSTEM AND METHOD FOR CALIBRATING BEARING OF WORK MACHINE

(71) Applicant: KOMATSU LTD., Tokyo (JP)

(72) Inventors: Kentaro Takayama, Tokyo (JP); Toru Kurakane, Tokyo (JP); Eiji Ishibashi, Tokyo (JP); Junji Harada, Tokyo (JP); Yasuo Wakabayashi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 364 days.

(21) Appl. No.: 17/909,521

(22) PCT Filed: May 25, 2021

(86) PCT No.: PCT/JP2021/019774
§ 371 (c)(1),
(2) Date: Sep. 6, 2022

(87) PCT Pub. No.: WO2021/261153
PCT Pub. Date: Dec. 30, 2021

(65) Prior Publication Data

US 2023/0295902 A1 Sep. 21, 2023

(30) Foreign Application Priority Data

Jun. 25, 2020 (JP) ..... 2020-109977

(51) Int. Cl.
*E02F 9/26* (2006.01)

(52) U.S. Cl.
CPC ..... *E02F 9/265* (2013.01); *E02F 9/267* (2013.01)

(58) Field of Classification Search
CPC . E02F 9/265; E02F 9/267; E02F 3/845; E02F 9/2296; E02F 9/262
See application file for complete search history.

(56) References Cited

U.S. PATENT DOCUMENTS 5,462,122 A 10/1995 Yamamoto et al.
6,062,317 A 5/2000 Gharsalli et al.
(Continued)

FOREIGN PATENT DOCUMENTS

CA 2 996 146 A1 2/2019
CN 103299087 A 9/2013
(Continued)

OTHER PUBLICATIONS

The Office Action for the corresponding Chinese application No. 202180021449.4, issued on Jan. 25, 2024.
(Continued)

*Primary Examiner* — Thomas E Worden
*Assistant Examiner* — Madison B Emmett
(74) *Attorney, Agent, or Firm* — Global IP Counselors, LLP

(57) ABSTRACT

A controller calculates a first bearing indicative of the bearing of a work machine based on first positional data and second positional data. The controller calculates the position of the work machine. The controller calculates a second bearing indicative of the bearing of the work machine based on a change in the position of the work machine in a predetermined zone when a determination condition, including a travel condition indicating that the work machine is traveling in a straight line, is satisfied within the predetermined zone. The controller calculates a correction value of the bearing of the work machine based on the difference between the first bearing and the second bearing in the predetermined zone. The controller corrects the first bearing based on the correction value.

17 Claims, 6 Drawing Sheets

(56) References Cited

U.S. PATENT DOCUMENTS

| | | | | |
|---|---|---|---|---|
| 2007/0177133 | A1 | 8/2007 | Cain et al. | |
| 2008/0269988 | A1* | 10/2008 | Feller | G05D 1/0278 701/41 |
| 2010/0312428 | A1* | 12/2010 | Roberge | G05D 1/027 717/106 |
| 2011/0231061 | A1* | 9/2011 | Reeve | A01B 69/008 701/41 |
| 2012/0174445 | A1* | 7/2012 | Jones | G01S 19/41 37/197 |
| 2013/0287601 | A1 | 10/2013 | Mori et al. | |
| 2014/0121909 | A1* | 5/2014 | Fehr | G01S 19/53 701/50 |
| 2014/0297040 | A1 | 10/2014 | Baba et al. | |
| 2016/0370805 | A1* | 12/2016 | Mazur | E02F 9/2054 |
| 2017/0342679 | A1* | 11/2017 | Iwamura | E02F 9/262 |
| 2018/0171598 | A1 | 6/2018 | Iwamura et al. | |
| 2019/0049973 | A1 | 2/2019 | Hashimoto et al. | |
| 2020/0356088 | A1* | 11/2020 | Schlacks, IV | G05D 1/0027 |
| 2020/0399862 | A1 | 12/2020 | Okazaki | |
| 2021/0029877 | A1* | 2/2021 | Vandike | A01D 69/00 |
| 2021/0148093 | A1 | 5/2021 | Shimada | |
| 2021/0209800 | A1* | 7/2021 | Atsumi | H04N 13/246 |
| 2022/0056674 | A1* | 2/2022 | Ishihara | E02F 9/264 |
| 2023/0055702 | A1* | 2/2023 | Rhyner | G05D 1/0027 |
| 2023/0324928 | A1* | 10/2023 | Kanai | B60K 35/80 701/25 |

FOREIGN PATENT DOCUMENTS

| | | | |
|---|---|---|---|
| CN | 106292417 | A | 1/2017 |
| CN | 109790696 | A | 5/2019 |
| JP | 7-26586 | A | 1/1995 |
| JP | 7-119178 | A | 5/1995 |
| JP | 7-266267 | A | 10/1995 |
| JP | 8-265625 | A | 10/1996 |
| JP | 2001-132019 | A | 5/2001 |
| JP | 2002-358122 | A | 12/2002 |
| JP | 2003-239328 | A | 8/2003 |
| JP | 2004-162504 | A | 6/2004 |
| JP | 2007-110921 | A | 5/2007 |
| JP | 2008-38418 | A | 2/2008 |
| JP | 2011-1775 | A | 1/2011 |
| JP | 2015-7370 | A | 1/2015 |
| JP | 2019-167691 | A | 10/2019 |
| JP | 2020-2708 | A | 1/2020 |
| JP | 2020-51200 | A | 4/2020 |
| WO | 98/03738 | A | 1/1998 |
| WO | 2017/072877 | A1 | 5/2017 |
| WO | 2019181189 | A1 | 9/2019 |

OTHER PUBLICATIONS

Li Yongjian, Automatic Navigation System of Tractor Based on DGPS and Double Closed-loop Steering Control published by Transactions of the Chinese Society for Agricultural Machinery; Feb. 2017, vol. 48 Issue 2, Guangzhou, China.

The International Search Report for the corresponding international application No. PCT/JP2021/19774, issued on Aug. 17, 2021.

* cited by examiner

SYSTEM AND METHOD FOR CALIBRATING BEARING OF WORK MACHINE

CROSS-REFERENCE TO RELATED APPLICATIONS

This application is a U.S. National stage application of International Application No. PCT/JP2021/019774, filed on May 25, 2021. This U.S. National stage application claims priority under 35 U.S.C. § 119(a) to Japanese Patent Application No. 2020-109977, filed in Japan on Jun. 25, 2020, the entire contents of which are hereby incorporated herein by reference.

TECHNICAL FIELD

The present invention relates to a system and a method for calibrating the bearing of a work machine.

BACKGROUND INFORMATION

A work machine is provided with a plurality of positional sensors. A controller of the work machine calculates the bearing of the work machine based on the position of each of the positional sensors. For example, Japanese Laid-open Patent 2003-239328 discloses a bulldozer provided with a plurality of GPS antennas. The controller of the bulldozer acquires the position of each antenna with GPS signals from the GPS antennas. The controller calculates the bearing of the bulldozer from the positional relationships among the plurality of GPS antennas.

SUMMARY

An error in the detection value of a positional sensor in a work machine may occur. For example, an error in the detection value of a positional sensor occurs if there is an error in the attachment position of a positional sensor or if the detection values of the positional sensor fluctuate. In this case, an error will arise between the calculated bearing of the work machine and the actual bearing of the work machine in the above work machine. Errors between the calculated bearing and the actual bearing can be calibrated with measurements using an external measurement apparatus, such as a total station. However, the work for calibrating is complicated in this case. An object of the present disclosure is to easily and accurately calibrate an error between a calculated bearing and the actual bearing of a work machine.

Means for Resolving the Problem

A system according to a first aspect of the present disclosure is a system for calibrating the bearing of a work machine calculated based on the positions of a plurality of positional sensors mounted to the work machine. The system according to the present aspect includes a first positional sensor, a second positional sensor, and a controller. The first positional sensor and the second positional sensor are mounted to the work machine. The controller communicates with the first positional sensor and the second positional sensor. The controller acquires first positional data that indicates the position of the first positional sensor and second positional data that indicates the position of the second positional sensor. The controller calculates a first bearing that indicates the bearing of the work machine based on the first positional data and the second positional data. The controller calculates the position of the work machine based on at least one of the first positional data and the second positional data. When a determination condition is satisfied within a predetermined zone, the controller calculates a second bearing that indicates the bearing of the work machine based on a change in the position of the work machine in the predetermined zone. The determination condition includes a travel condition that indicates that the work machine is traveling in a straight line. The controller calculates a correction value of the bearing of the work machine within the predetermined zone based on the difference between the first bearing and the second bearing. The controller corrects the first bearing based on the correction value.

A method according to a second aspect of the present disclosure is a method for calibrating the bearing of the work machine calculated based on the positions of a plurality of positional sensors mounted to the work machine. The plurality of positional sensors includes a first positional sensor and a second positional sensor. The method according to the present aspect includes the following processes. A first process is acquiring first positional data that indicates the position of the first positional sensor, and second positional data that indicates the position of the second positional sensor. A second process is calculating a first bearing that indicates the bearing of the work machine based on the first positional data and the second positional data. A third process is calculating the position of the work machine based on at least one of the first positional data and the second positional data. A fourth process is calculating a second bearing that indicates the bearing of the work machine based on a change in the position of the work machine in a predetermined zone when a determination condition within the predetermined zone is satisfied. The determination condition includes a travel condition that indicates that the work machine is traveling in a straight line. A fifth process is calculating a correction value of the bearing of the work machine based on the difference between the first bearing and the second bearing within the predetermined zone. A sixth process is correcting the first bearing based on the correction value. The order of the execution of the above processes is not limited to the above-mentioned order and may be changed.

According to the system and method as in the present disclosure, the first bearing is calibrated by using a second bearing calculated based on a change in the position of the work machine. The second bearing is acquired without the use an external measurement apparatus while the work machine is traveling. As a result, an error between the calculated bearing and the actual bearing of the work machine can be calibrated easily. In addition, the determination condition includes a travel condition that indicates that the work machine is traveling in a straight line. As a result, the calibration can be performed accurately.

DESCRIPTION OF EMBODIMENTS

Figure 1:
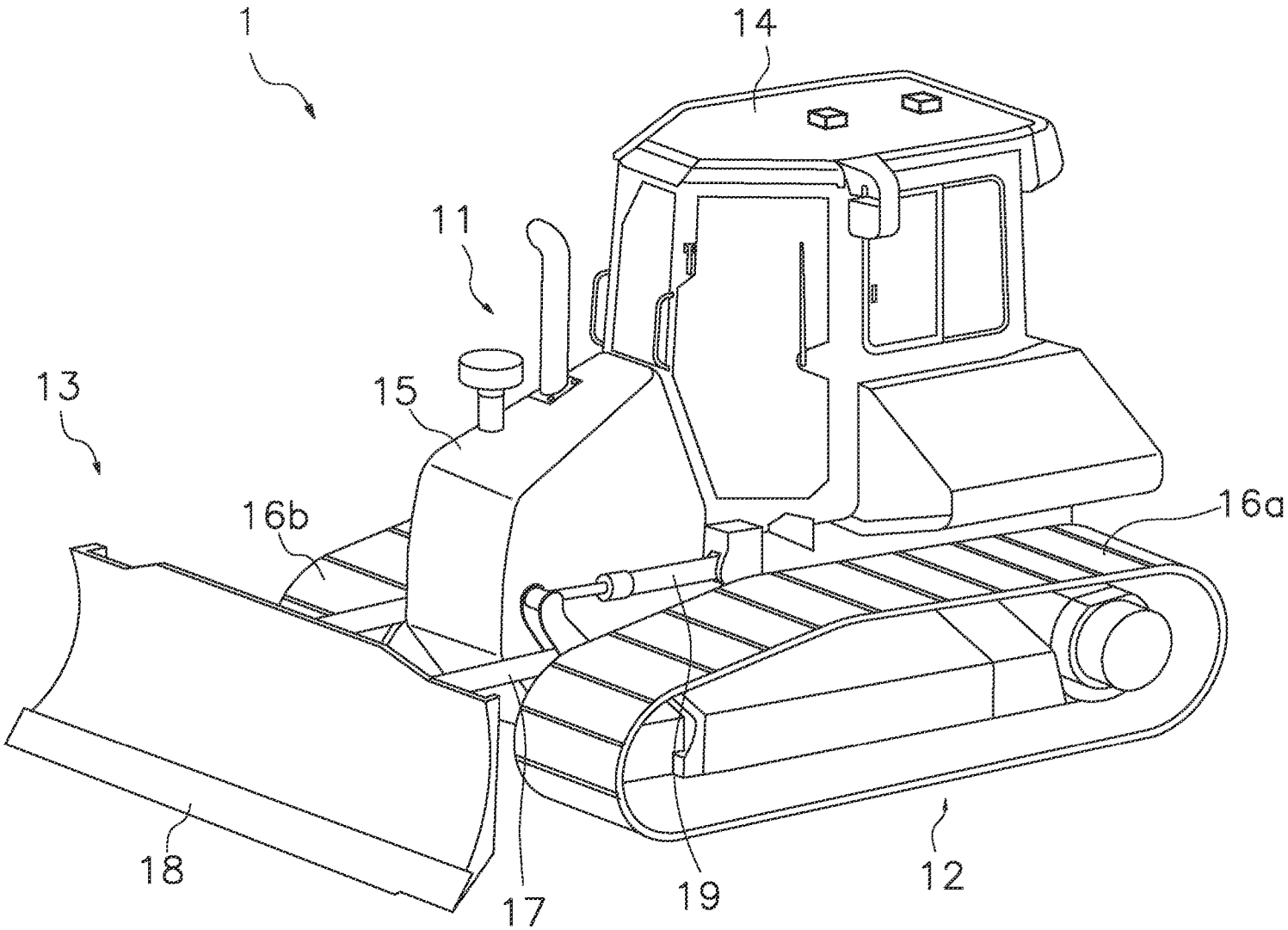
FIG. 1 is a perspective view of a work machine.

A work machine 1 according to an embodiment is discussed hereinbelow with reference to the drawings. FIG. 1 is a perspective view of the work machine 1 according to an embodiment. The work machine 1 according to the present embodiment is a bulldozer. The work machine 1 includes a vehicle body 11, a travel device 12, and a work implement 13.

The vehicle body 11 includes an operating cabin 14 and an engine compartment 15. An operator's seat that is not illustrated is disposed in the operating cabin 14. The engine compartment 15 is disposed in front of the operating cabin 14. The travel device 12 is attached to a bottom part of the vehicle body 11. The travel device 12 includes a left crawler belt 16*a* and a right crawler belt 16*b*. The work machine 1 travels due to the rotation of the crawler belts 16*a* and 16*b*. The travel of the work machine 1 may be in the form of automated travel, semi-automated travel, or travel based on operations by an operator.

The work implement 13 is attached to the vehicle body 11. The work implement 13 includes a lift frame 17, a blade 18, and a lift cylinder 19. The lift frame 17 is attached to the vehicle body 11 movably up and down about an axis that extends in the vehicle width direction. The lift frame 17 supports the blade 18. The blade 18 is disposed in front of the vehicle body 11. The blade 18 moves up and down accompanying the up and down movements of the lift frame 17. The lift cylinder 19 is coupled to the vehicle body 11 and the lift frame 17. The lift frame 17 moves up and down due to the extension and contraction of the lift cylinder 19.

Figure 2:
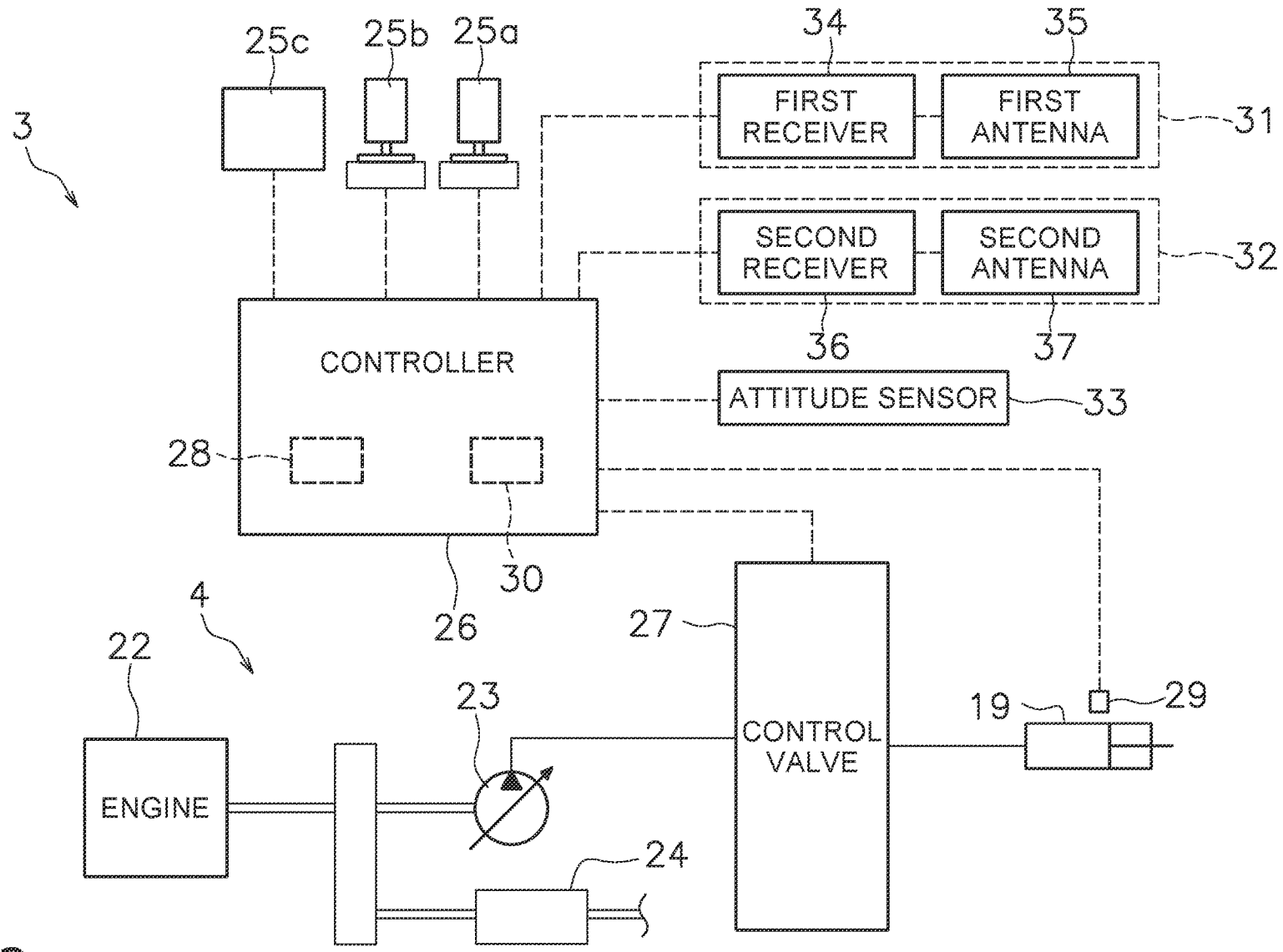
FIG. 2 is a block diagram illustrating a control system of the work machine.

FIG. 2 is a block diagram illustrating a configuration of a control system 3 and a drive system 4 of the work machine 1. As illustrated in FIG. 2, the drive system 4 includes an engine 22, a hydraulic pump 23, and a power transmission device 24. The hydraulic pump 23 is driven by the engine 22 and discharges hydraulic fluid. The hydraulic fluid discharged from the hydraulic pump 23 is supplied to the lift cylinder 19. While only one hydraulic pump 23 is illustrated in FIG. 2, a plurality of hydraulic pumps may be provided.

The power transmission device 24 transmits driving power from the engine 22 to the travel device 12. The power transmission device 24, for example, may be a hydrostatic transmission (HST). Alternatively, the power transmission device 24, for example, may be a transmission including a torque converter or a plurality of speed change gears.

The control system 3 includes a first operating device 25*a*, a second operating device 25*b*, an input device 25*c*, a controller 26, and a control valve 27. The first operating device 25*a* is a device for operating the travel device 12. The first operating device 25*a* is disposed in the operating cabin 14. The first operating device 25*a* receives an operation from the operator for driving the travel device 12 and outputs an operation signal corresponding to the operation. The first operating device 25*a* includes, for example, an operating lever, a pedal, or a switch and the like.

The first operating device 25*a* is operable between a forward movement position, a reverse movement position, and a neutral position. The first operating device 25*a* is operable between a left turn position and a right turn position. An operation signal indicating the position of the first operating device 25*a* is output to the controller 26. The controller 26 controls the travel device 12 or the power transmission device 24 so that the work machine 1 moves forward when the operating position of the first operating device 25*a* is the forward movement position. The controller 26 controls the travel device 12 or the power transmission device 24 so that the work machine 1 moves in reverse when the operating position of the first operating device 25*a* is the reverse movement position.

The controller 26 controls the travel device 12 or the power transmission device 24 so that the work machine 1 turns to the left when the operating position of the first operating device 25*a* is the left turn position. The controller 26 controls the travel device 12 or the power transmission device 24 so that the work machine 1 turns to the right when the operating position of the first operating device 25*a* is the right turn position.

The second operating device 25*b* is a device for operating the work implement 13. The second operating device 25*b* is disposed in the operating cabin 14. The second operating device 25*b* receives an operation from the operator for driving the work implement 13 and outputs an operation signal corresponding to the operation. The second operating device 25*b* includes, for example, an operating lever, a pedal, or a switch and the like.

For example, the second operating device 25*b* is operable between a raising position, a lowering position, and a neutral position. An operation signal indicating the position of the second operating device 25*b* is output to the controller 26. The controller 26 controls the control valve 27 to raise the work implement 13 when the operating position of the second operating device 25*b* is the raising position. The controller 26 controls the control valve 27 to lower the work implement 13 when the operating position of the second operating device 25*b* is the lowering position.

The input device 25*c* is, for example, touch screen-type input device. The input device 25 may be an input device such as a switch. The operator can use the input device 25*c* to input a setting for controlling the work machine 1.

The controller 26 is programmed to control the work machine 1 based on acquired data. The controller 26 includes a storage device 28 and a processor 30. The processor 30 includes, for example, a CPU. The storage device 28 may include a memory, such as a RAM or a ROM, for example. The storage device 28 may include an auxiliary recording medium, such as a semiconductor memory or a hard disk and the like. The storage device 28 is an example of a non-transitory computer-readable recording medium. The storage device 28 records computer commands that are executable by the processor 30 and that are for controlling the work machine 1.

The controller 26 acquires operation signals from the first operating device 25*a* and the second operating device 25*b*. The controller 26 controls the control valve 27 based on the operation signals. The controller 26 is not limited to one component and may be divided into a plurality of controllers.

The control valve 27 is a proportional control valve and is controlled with command signals from the controller 26. The control valve 27 is disposed between the hydraulic pump 23 and hydraulic actuators, such as the lift cylinder 19. The control valve 27 controls the flow rate of the hydraulic fluid supplied from the hydraulic pump 23 to the lift cylinder 19. The controller 26 generates a command signal for the control valve 27 so that the blade 18 moves in accordance with the above-mentioned operation of the second operating device 25*b*. As a result, the lift cylinder 19 is controlled in response to the operation amount of the second operating device 25*b*. The control valve 27 may also be a pressure proportional control valve. Alternatively, the control valve 27 may be an electromagnetic proportional control valve.

The control system 3 includes a lift angle sensor 29. The lift angle sensor 29 detects a lift angle of the blade 18. The lift angle is the angle of the work implement 13 from the origin position of the work implement 13. The origin position of the work implement 13 is, for example, the position of the blade 18 while the blade tip of the blade 18 is in contact with the ground surface on a horizontal ground surface. The lift angle sensor 29 may detect the stroke length of the lift cylinder 19. The controller 26 may calculate the lift angle of the blade 18 based on the lift cylinder length. Alternatively, the lift angle sensor 29 may detect the lift angle of the blade 18 directly.

As illustrated in FIG. 2, the control system 3 includes a first positional sensor 31, a second positional sensor 32, and an attitude sensor 33. The first positional sensor 31 and the second positional sensor 32 detect the position and bearing of the work machine 1. The first positional sensor 31 and the second positional sensor 32 are, for example, sensors of a global navigation satellite system (GNSS), such as a global positioning system (GPS). The first positional sensor 31 outputs first positional data that indicates the position of the first positional sensor 31. The second positional sensor 32 outputs second positional data that indicates the position of the second positional sensor 32.

Figure 3:
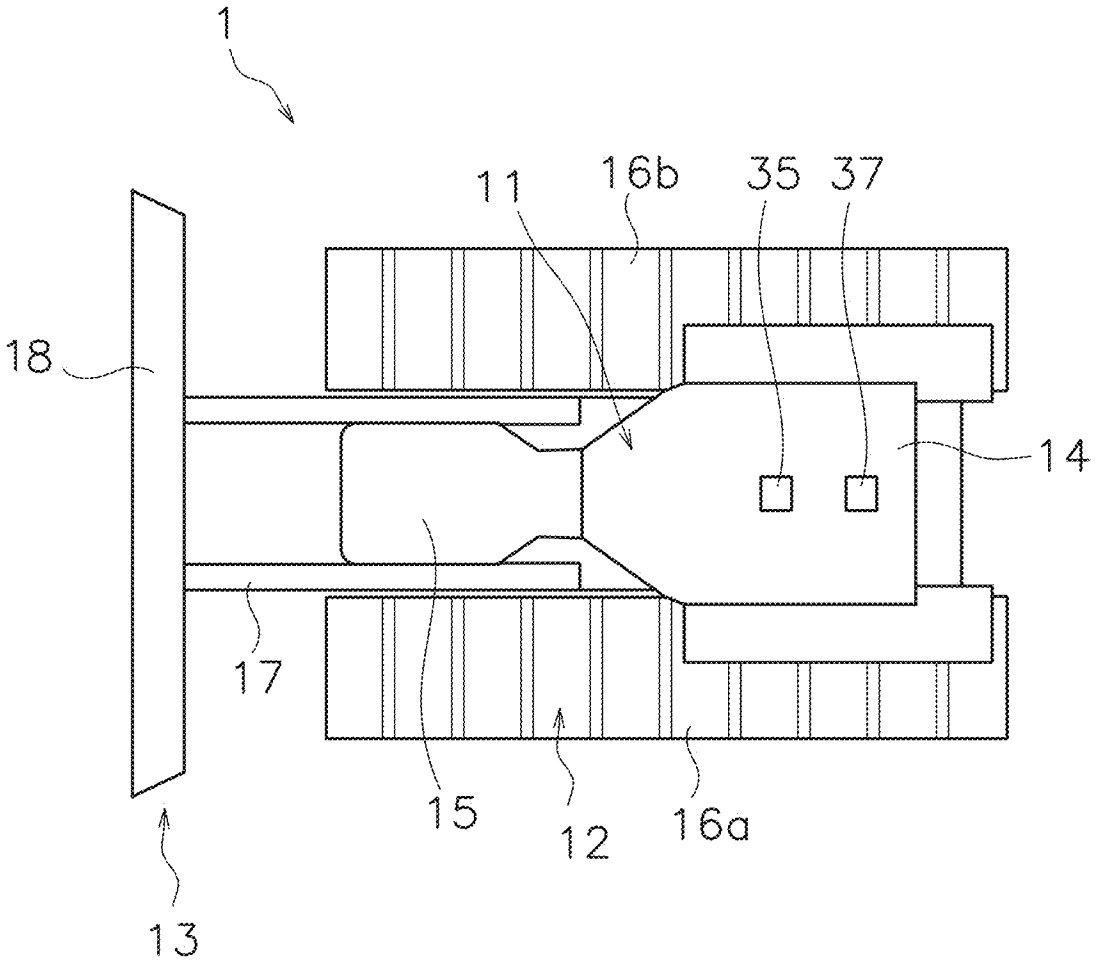
FIG. 3 is top view of the work machine.

The first positional sensor 31 includes a first receiver 34 and a first antenna 35. The first receiver 34 receives a positioning signal from a satellite, computes the position of the first antenna 35 from the positioning signal, and generates the first positional data. The position of the first positional sensor 31 signifies the position of the first antenna 35. The second positional sensor 32 includes a second receiver 36 and a second antenna 37. The second receiver 36 receives a positioning signal from a satellite, computes the position of the second antenna 37 from the positioning signal, and generates the second positional data. The position of the second positional sensor 32 signifies the position of the second antenna 37. FIG. 3 is a top view of the work machine 1. As illustrated in FIG. 3, the first antenna 35 and the second antenna 37 are mounted to the vehicle body 11. The first antenna 35 and the second antenna 37 are disposed to be aligned in the front-back direction of the vehicle body 11. The second antenna 37 is disposed behind the first antenna 35.

The controller 26 acquires the first positional data from the first positional sensor 31. The controller 26 acquires the second positional data from the second positional sensor 32. The first positional data indicates the position of the first positional sensor 31 in a global coordinate system. The second positional data indicates the position of the second positional sensor 32 in the global coordinate system.

The attitude sensor 33 is, for example, an inertial measurement unit (IMU). The attitude sensor 33 outputs inclination angle data of the vehicle body 11. The inclination angle data of the vehicle body 11 includes the pitch angle and the roll angle of the vehicle body 11. That is, the attitude sensor 33 is a pitch angle sensor for detecting the pitch angle of the vehicle body 11 and a roll angle sensor for detecting the roll angle of the vehicle body 11. The pitch angle is an angle in the front-back direction of the vehicle body 11 with respect to the horizontal direction. The roll angle is an angle in the lateral direction of the vehicle body 11 with respect to the horizontal direction. The controller 26 acquires the inclination angle data from the attitude sensor 33.

The controller 26 computes a blade tip position P0 of the blade 18 from the first positional data, the inclination angle data, and the lift angle of the blade 18. The controller 26 calculates local coordinates of the blade tip position P0 based on the lift angle and vehicle body dimension data. The local coordinate system is a coordinate system based on the vehicle body 11. The global coordinate system is an external coordinate system of the vehicle body 11. The vehicle body dimension data indicates a positional relationship between a point of origin position of the vehicle body 11 and the blade tip position P0 in the local coordinate system. The vehicle body dimension data indicates a positional relationship between the point of origin position of the vehicle body 11 and the first positional sensor 31 in the local coordinate system. The vehicle body dimension data indicates a positional relationship between the point of origin position of the vehicle body 11 and the second positional sensor 32 in the local coordinate system. The vehicle body dimension data indicates a positional relationship between the first positional sensor 31 and the second positional sensor 32 in the local coordinate system. The vehicle body dimension data is stored in the storage device 28.

The controller 26 calculates the global coordinates of the blade tip position P0 based on the global coordinates of the first positional sensor 31, the local coordinates of the blade tip position P0, the inclination angle data, and the vehicle body dimension data. The controller 26 calculates a first bearing that indicates the bearing of the vehicle body 11 in the global coordinates, from the global coordinates of the first positional sensor 31 and the global coordinates of the second positional sensor 32. Specifically, the controller 26 determines the direction from the position of the second positional sensor 32 toward the position of the first positional sensor 31 as the first bearing.

The storage device 28 stores work site data. The work site data indicates the actual topography of the work site. The work site data is, for example, a topographical survey map of the work site in a three-dimensional data format.

Figure 4:
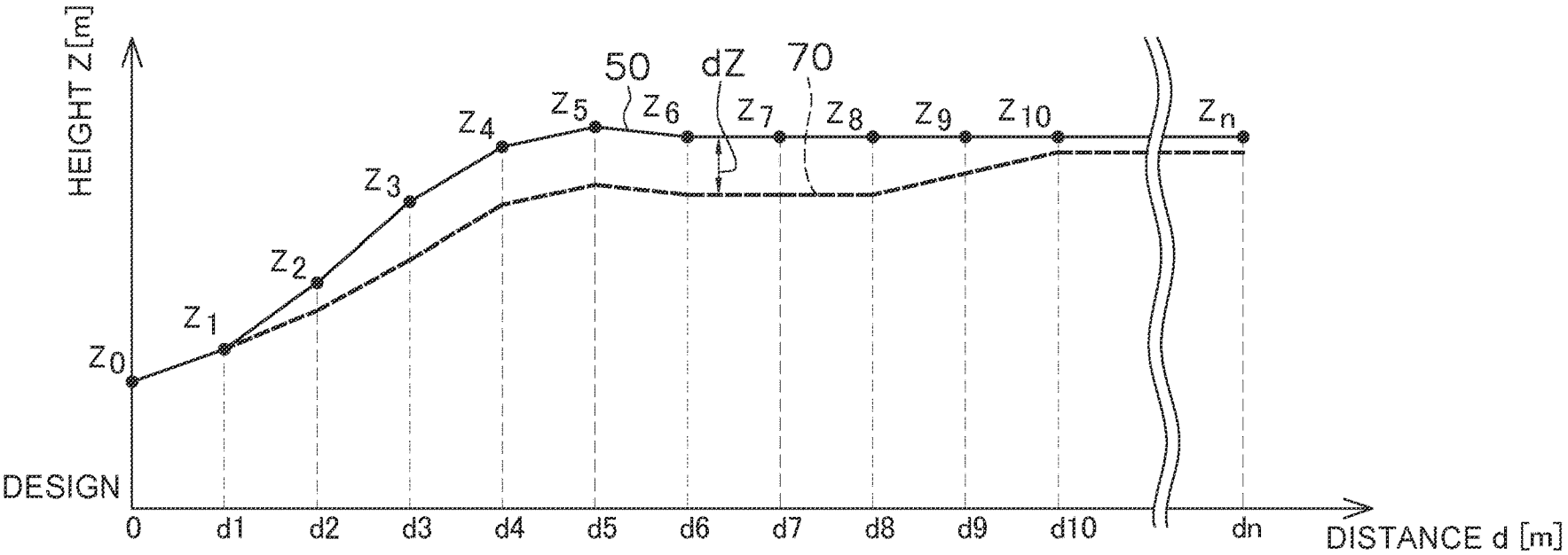
FIG. 4 illustrates an example including an actual topography and a target design topography.

The controller 26 acquires actual topography data. The actual topography data indicates the actual topography 50 of the work site. FIG. 4 illustrates a cross-section of the actual topography 50. In FIG. 4, the vertical axis represents the height of the topography and the horizontal axis represents the distance from the current position in the traveling direction of the work machine 1.

The actual topography data is information that indicates the topography located in the traveling direction of the work machine 1. The actual topography data is acquired by means of calculation by the controller 26 from the work site data, the current position of the work machine 12, and the first bearing. The actual topography data indicates the actual topography 50 from the current position of the work machine 1 as far as a predetermined distance dn in the first bearing. Specifically, the actual topography data includes heights Z0 to Zn of the actual topography 50 at a plurality of reference points from the current position of the work machine 1 as far as a predetermined distance dn in the first bearing. In the present embodiment, the current position is a position defined based on the current blade tip position Pb of the work machine 1. However, the current position may also be defined based on the current position of another portion of the work machine 1. The plurality of reference points are aligned with a predetermined interval, for example 1 m, between each point.

The controller 26 automatically controls the work implement 13 based on the actual topography data, the blade tip position P0, and the first bearing. The automatic control of the work implement 13 may be a semi-automatic control that is performed in accompaniment to manual operations by the operator. Alternatively, the automatic control of the work implement 13 may be a fully automatic control that is performed without manual operations by an operator.

The controller 26 determines a target design topography 70 based on the actual topography 50. For example, as illustrated in FIG. 4, the controller 26 determines the target design topography 70 located below the actual topography 50 by a distance dZ. The controller 26 performs a control to operate the work machine 1 in accordance with the target design topography 70 based on the current position and the first bearing of the work machine 1. Consequently, the actual topography 50 is excavated so that the actual topography 50 assumes a shape in accordance with the target design topography 70 due to the work machine 1. Alternatively, the controller 26 may determine the target design topography 70 located above the actual topography 50. In such a case, soil is piled on the actual topography 50 so that the actual topography 50 assumes a shape in accordance with the target design topography 70 due to the work machine 1.

Figure 5:
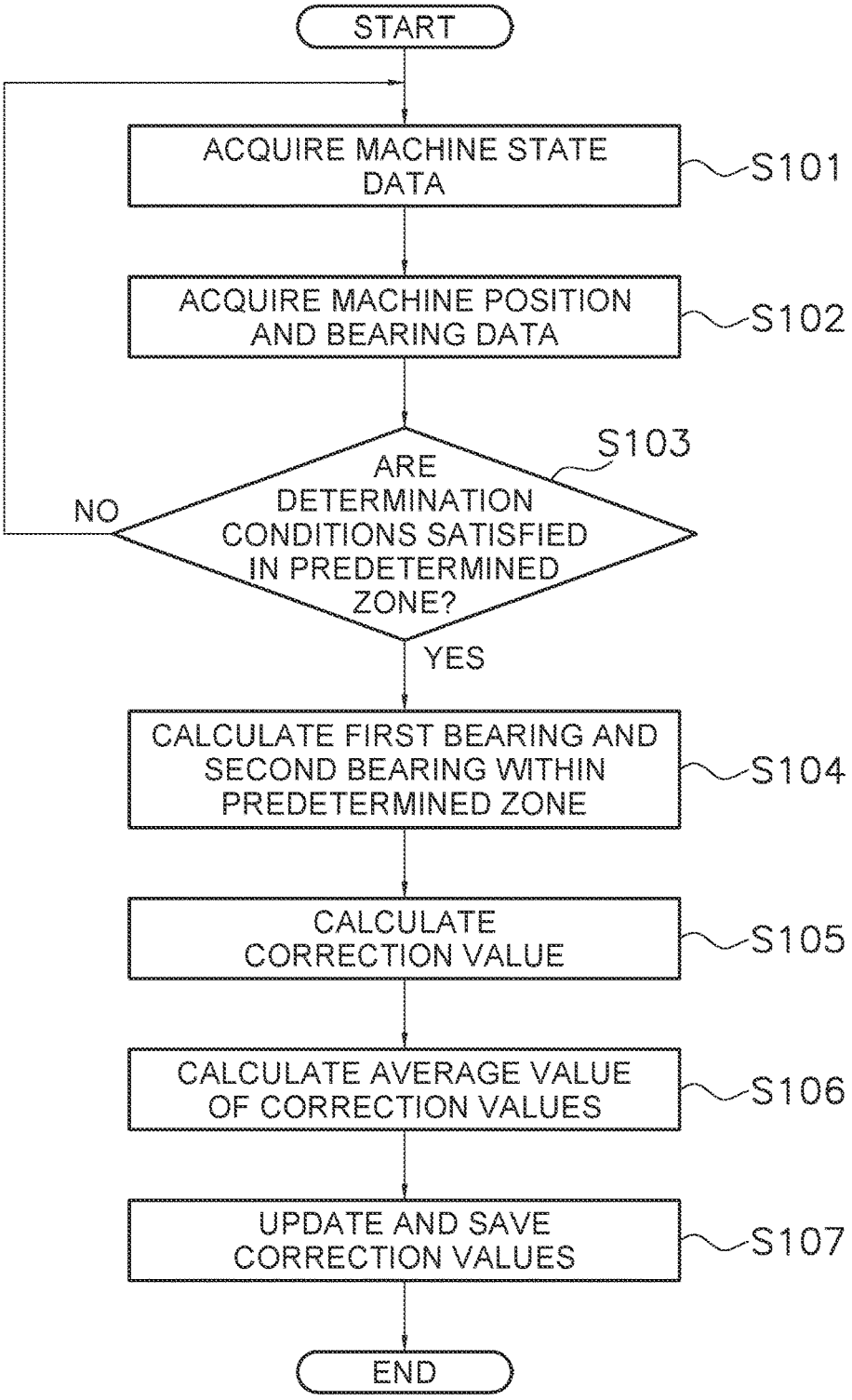
FIG. 5 is a flow chart illustrating a method for calibrating the bearing of the work machine.

Next, processing for calibrating the first bearing calculated based on the position of the first positional sensor 31 and the position of the second positional sensor 32 will be explained. FIG. 5 is a flow chart depicting processing for calibrating the first bearing.

In step S101, the controller 26 acquires machine state data. The machine state data includes the travel velocity, the roll angle, the pitch angle, a turning operating state, the work implement position, and the work implement operating state of the work machine 1. The travel velocity is calculated from a change in the positions of the first positional sensor 31 and/or the second positional sensor 32. Alternatively, the travel velocity may be calculated from the rotation speed of the power transmission device 24 or the travel device 12. The roll angle and the pitch angle are acquired from the above-mentioned inclination angle data of the vehicle body 11.

The turning operating state indicates the presence of a turning operation by the first operating device 25*a*. The turning operating state is acquired based on an operation signal from the first operating device 25*a*. Alternatively, the turning operating state may be acquired based on a signal from a sensor, such as an IMU, that detects the attitude of the work machine 1. The work implement position indicates the height position of the blade. The work implement position may be acquired based on a signal from the lift angle sensor 29. The work implement operating state indicates whether the work implement 13 is being operated. The work implement operating state is acquired based on an operation signal from the second operating device 25*b*. The controller 26 repeatedly acquires and records the machine state data over a predetermined sample cycle.

In step S102, the controller 26 acquires machine position and bearing data. The machine position and bearing data includes the position and the first bearing of the work machine 1. The position of the work machine 1 is acquired based on the position of the first positional sensor 31 and/or the position of the second positional sensor 32. The position of the work machine 1 is a position defined from at least one of the first positional sensor 31 and the second positional sensor 32. For example, the position of the work machine 1 may be the position of the first positional sensor 31. Alternatively, the position of the work machine 1 may be the position of the second positional sensor 32. Alternatively, the position of the work machine 1 may be a position between the first positional sensor 31 and the second positional sensor 32. The first bearing is calculated based on the position of the first positional sensor 31 and the position of the second positional sensor 32. The controller 26 repeatedly acquires and records the machine position and bearing data over a predetermined sample cycle.

In step S103, the controller 26 determines whether the determination conditions are continuously satisfied within a predetermined zone. The predetermined zone may be defined by the movement distance of the work machine 1. Alternatively, the predetermined zone may be defined by the movement time of the work machine 1. The determination conditions include travel conditions and non-working conditions. The travel conditions signify that the work machine 1 is traveling in a straight line on flat ground. The non-working conditions signify that the work machine 1 is not performing work with the work implement.

The controller 26 determines whether the travel conditions are satisfied from the machine state data and the machine position and bearing data. The controller 26 determines whether the non-working conditions are satisfied from the machine state data. The controller 26 determines that the determination conditions are satisfied when both the travel conditions and the non-working conditions are satisfied.

Specifically, the travel conditions include the following first to seventh travel conditions. The first travel condition is that the travel velocity of the work machine 1 is greater than or equal to a predetermined velocity threshold. The second travel condition is that the size of change of the first bearing is less than or equal to a first threshold. The third travel condition is that the work machine 1 is not turning. The fourth travel condition is that the size of a change of the roll angle of the work machine 1 is less than or equal to a second threshold.

The fifth travel condition is that the size of a change of the pitch angle of the work machine 1 is less than or equal to a third threshold. The sixth travel condition is that the roll angle of the work machine 1 is less than or equal to a fourth threshold. The seventh travel condition is that the pitch angle of the work machine 1 is less than or equal to a fifth threshold. The controller 26 determines that the travel conditions are satisfied when all of the first to seventh travel conditions are continuously satisfied within the predetermined zone. The afore-mentioned thresholds are set to values appropriate for calibrating the first bearing with accuracy.

The non-working conditions include a first non-working condition and a second non-working condition as indicated below. The first non-working condition is that the second operating device 25*b* is in a non-operating state. The second non-working condition is that the height position of the work implement is at least a predetermined height or higher. The controller 26 determines that the non-working conditions are satisfied when all of the first to second non-working conditions are continuously satisfied within the predetermined zone.

Figure 6:
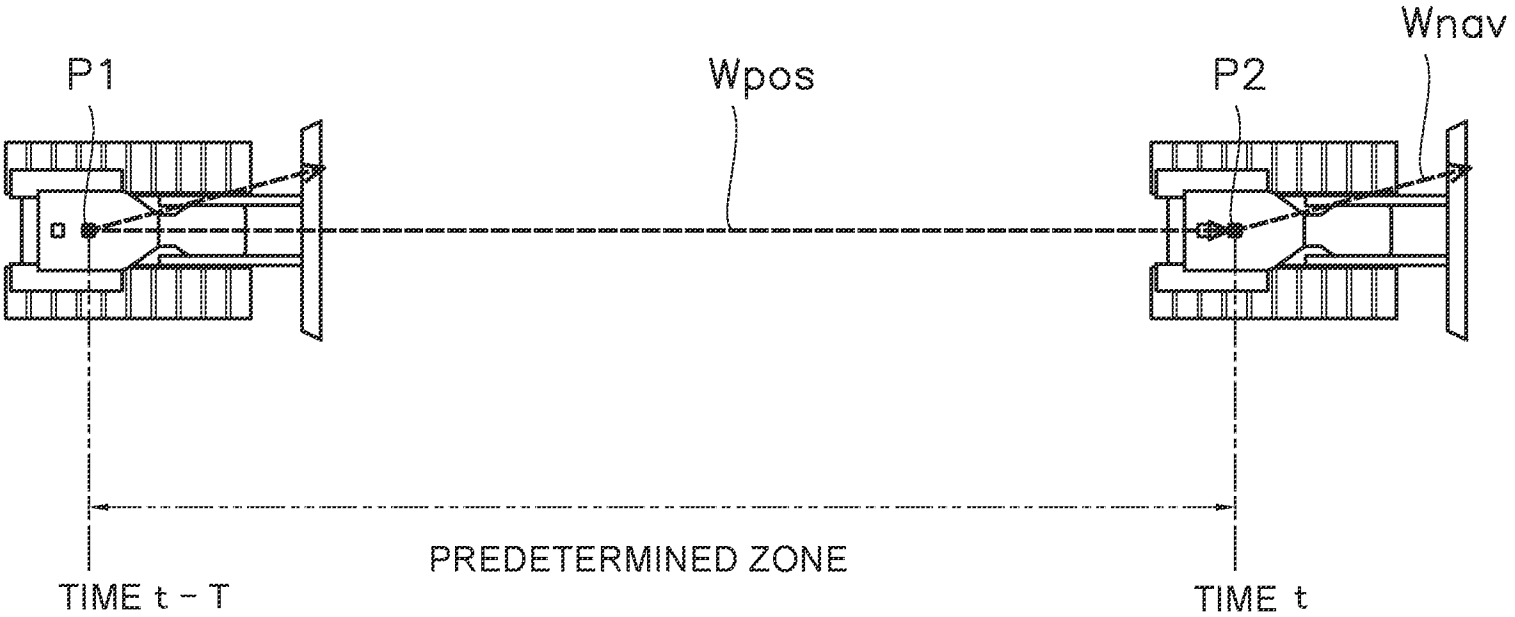
FIG. 6 illustrates a method for calibrating the bearing of the work machine.

When the controller 26 has determined that the determination conditions are continuously satisfied within the predetermined zone, the processing advances to step S104. In step S104, the controller 26 calculates the first bearing and a second bearing within the predetermined zone. FIG. 6 illustrates an example in which the determination conditions are satisfied in the predetermined zone from a starting time t-T to an ending time t. The controller 26 calculates an average value of the first bearing from the starting time t-T to the ending time t, as a first bearing Wnav within the predetermined zone.

The controller 26 calculates the second bearing that indicates the bearing of the work machine 1 based on a change in the position of the work machine 1 within the predetermined zone. Specifically, the controller 26 calculates the bearing from a starting position P1 to an ending position P2 within the predetermined zone as the second bearing. The controller 26 calculates a second bearing Wpos using the following equation (1).

$$Wpos = a\tan 2(Eg-Es, Ng-Ns) \quad (1)$$

The global coordinates of the starting position P1 are (Es, Ns, Zs). The global coordinates of the ending position P2 are (Eg, Ng, Zg). The starting position P1 may be an average value of the position of the work machine 1 from the starting time t-T until after a predetermined time period. The ending position P2 may be an average value of the position of the work machine 1 from the ending time t until before the predetermined time period.

In step S105, the controller 26 calculates a correction value of the bearing of the work machine 1. The controller 26 saves the correction value in the storage device 28. The controller calculates the correction value of the bearing of the work machine 1 based on the difference between the first bearing Wnav and the second bearing Wpos within the predetermined zone. Specifically, the controller 26 calculates the correction value Dwl using the following equation (2).

$$Dwl = Wnav - Wpos$$

In step S106, the controller 26 calculates an average value of the correction values. The controller 26 repeatedly executes the processing from step S101 to step S107 illustrated in FIG. 5 every time the work machine 1 travels. In addition, the controller 26 repeatedly executes the processing from step S101 to step S107 illustrated in FIG. 5 while the work machine 1 is traveling. The controller 26 saves the current correction value and the plurality of past correction values in the storage device 28. The controller 26 calculates the average value of the correction values from the current correction value and the past correction values. The controller 26 calculates the average value of the correction values from the latest of a predetermined number of the past correction values. Alternatively, the controller 26 may calculate the average value of the correction values from the current correction value and the past correction values from the current time up to a predetermined time period before. Alternatively, the controller 26 may calculate the average value of the correction values from the current correction value and all of the past correction values.

In step S107, the controller 26 updates and saves the average value of the correction values as correction values for correcting the first bearing. Thereafter, when determining the first bearing, the controller 26 uses the updated correction value to correct the first bearing calculated based on the position of the first positional sensor 31 and the position of the second positional sensor 32.

According to the work machine 1 as in the present embodiment as discussed above, the first bearing is calibrated by using a second bearing calculated based on a change in the position of the work machine 1. The second bearing is acquired without the use of an external measurement apparatus while the work machine is traveling. As a result, an error between the calculated bearing and the actual bearing of the work machine 1 can be calibrated easily. In addition, the determination conditions include travel conditions that indicate that the work machine 1 is traveling in a straight line. As a result, the calibration can be performed accurately. Furthermore, by using an average value of the correction values, errors due to fluctuation over time of the detection values of the sensors 31 and 32 can be accurately calibrated.

Although one embodiment of the present invention has been described so far, the present invention is not limited to the above embodiment and various modifications may be made within the scope of the invention. The work machine 1 is not limited to a bulldozer, and may be another type of machine, such as a wheel loader, a motor grader, a dump truck, or the like.

The work machine 1 may be a vehicle that can be remotely operated. In this case, a portion of the control system 3 may be disposed outside of the work machine 1. For example, the controller 26 may be disposed outside the work machine 1. The controller 26 may be disposed inside a control center separated from the work site.

The first operating device 25*a*, the second operating device 25*b*, and the input device 25*c* may be disposed outside of the work machine 1. In this case, the operating cabin may be omitted from the work machine 1. The first operating device 25*a*, the second operating device 25*b*, and the input device 25*c* may be omitted from the work machine 1. The work machine 1 may be operated with only the automatic control by the controller 26 without operations via the first operating device 25*a* or the second operating device 25*b*.

The number of sensors is not limited to two and may be three or more. The dispositions of the positional sensors are not limited to those of the above embodiment and may be changed. For example, the first positional sensor 31 and the second positional sensor 32 may be aligned in the width direction of the work machine 1. The positional sensors are not limited to sensors of a positioning system based on the Earth. The positional sensors may be sensors of a positioning system based on a specific region, such as a work site.

The order of the processing by the controller 26 is not limited to that of the above embodiment and may be changed. The processing by the controller 26 is not limited to the above embodiment and may be changed. The processing for performing automatic control of the work implement 13 in accordance with the target design topography 70 may be omitted. The controller 26 may cause the work machine 1 to travel automatically to a destination based on the position and the first bearing of the work machine 1.

The above-mentioned processing for calculating the correction values may be executed constantly without specific instructions from an operator during the normal work of the work machine 1. Alternatively, the processing for calculating the correction values may be executed when a calibration instruction is inputted by an operator using a device such as the input device 25*c*. The processing for calculating the correction values may be executed when the positions of the positional sensors are determined to be correct. The processing for calculating the correction values may be executed when the machine state data and the machine position and bearing data are determined to be suitable.

The determination conditions are not limited to those of the above embodiment and may be added to, omitted, or changed. For example, the travel conditions are not limited to those of the above embodiment and may be added to, omitted, or changed. The non-working conditions are not limited to those of the above embodiment and may be added to, omitted, or changed.

According to the present disclosure, calibrating an error between a calculated bearing and the actual bearing of a work machine can be performed easily and accurately.

The invention claimed is:

1. A system for calibrating a bearing of a work machine calculated based on positions of a plurality of positional sensors mounted to the work machine, the system comprising:

a first positional sensor mounted to the work machine, the first positional sensor including a first receiver and a first antenna, the first receiver being configured to receive a first positioning signal from a satellite, calculate a position of the first antenna based on the first positioning signal, and generate first position data indicative of the position of the first antenna;

a second positional sensor mounted to the work machine, the second positional sensor including a second receiver and a second antenna, the second receiver being configured to receive a second positioning signal from the satellite, calculate a position of the second antenna based on the second positioning signal, and generate second position data indicative of the position of the second antenna; and a controller configured to communicate with the first positional sensor and the second positional sensor, the controller being further configured to acquire the first position data and the second position data, calculate a first bearing indicative of the bearing of the work machine based on the first position data and the second position data, calculate a position of the work machine based on at least one of the first position data and the second position data, calculate a second bearing indicative of the bearing of the work machine based on a change in the position of the work machine in a predetermined zone when a determination condition, including a travel condition indicating that the work machine is traveling in a straight line, is satisfied within the predetermined zone, calculate a correction value of the bearing of the work machine within the predetermined zone based on a difference between the first bearing and the second bearing, correct the first bearing based on the correction value, determine a target design topography, and control the work machine to operate in accordance with the target design topography based on the position of the work machine and the first bearing or to automatically drive the work machine to a destination based on the position of the work machine and the first bearing.

2. The system according to claim 1, wherein the travel condition includes an amount of a change of the first bearing within the predetermined zone is less than or equal to a first threshold.

3. The system according to claim 1, wherein the travel condition includes the work machine not turning.

4. The system according to claim 1, further comprising a roll angle sensor configured to detect a roll angle of the work machine, the travel condition including an amount of a change of the roll angle of the work machine within the predetermined zone being less than or equal to a second threshold.

5. The system according to claim 1, further comprising a pitch angle sensor configured to detect a pitch angle of the work machine, the travel condition including an amount of a change of the pitch angle of the work machine within the predetermined zone being less than or equal to a third threshold.

6. The system according to any one of claim 1, further comprising a roll angle sensor configured to detect a roll angle of the work machine, the travel condition including the roll angle of the work machine within the predetermined zone being less than or equal to a fourth threshold.

7. The system according to claim 1, further comprising a pitch angle sensor configured to detect a pitch angle of the work machine, the travel condition including the pitch angle of the work machine within the predetermined zone being less than or equal to a fifth threshold.

8. The system according to claim 1, wherein the work machine includes a work implement, and the determination condition further includes a non-working condition indicative of the work implement not being operated.

9. The system according to claim 8, wherein the work machine further includes an operating device for operating the work implement, and the non-working condition includes the operating device being in a non-operating state.

10. The system according to claim 8, wherein the non-working condition includes a height position of the work implement being at least a predetermined height or higher.

11. The system according to claim 1, wherein the controller is configured to repeatedly execute to calculate the correction value a plurality of times, and update the correction value with an average value of the correction values from the plurality of times.

12. The system according to claim 1, wherein the work machine includes a work implement.

13. The system according to claim 1, wherein the travel condition further includes a travel velocity of the work machine being greater than or equal to a predetermined velocity threshold.

14. A method for calibrating a bearing of a work machine calculated based on positions of a plurality of positional sensors including a first positional sensor and a second positional sensor mounted to the work machine, the first positional sensor including a first receiver and a first antenna, the first receiver being configured to receive a first positioning signal from a satellite, calculate a position of the first antenna based on the first positioning signal, and generate first position data indicative of the position of the first antenna, and the second positional sensor including a second receiver and a second antenna, the second receiver being configured to receive a second positioning signal from the satellite, calculate a position of the second antenna based on the second positioning signal, and generate second position data indicative of the position of the second antenna, the method comprising:

acquiring the first position data and the second position data;

calculating a first bearing indicative of the bearing of the work machine based on the first position data and the second position data;

calculating a position of the work machine based on at least one of the first position data and the second position data;

calculating a second bearing indicative of the bearing of the work machine based on a change in the position of the work machine in a predetermined zone when a determination condition including a travel condition, indicating that the work machine is traveling in a straight line within the predetermined zone, is satisfied;

calculating a correction value of the bearing of the work machine based on a difference between the first bearing and the second bearing within the predetermined zone;

correcting the first bearing based on the correction value, determining a target design topography, and controlling the work machine to operate in accordance with the target design topography based on the position of the work machine and the first bearing or to automatically drive the work machine to a destination based on the position of the work machine and the first bearing.

15. The method according to claim 14, wherein the work machine includes a work implement, and the determination condition further includes a non-working condition indicating that the work implement is not being operated.

16. The method according to claim 14, further comprising repeatedly executing to calculate the correction value a plurality of times, and updating the correction value with an average value of the correction values from the plurality of times.

17. The method according to claim 14, wherein the work machine includes a work implement.

* * * * *